US011486300B2

(12) United States Patent
Sugita et al.

(10) Patent No.: US 11,486,300 B2
(45) Date of Patent: Nov. 1, 2022

(54) V-TYPE OHV ENGINE

(71) Applicant: YAMAHA MOTOR POWER PRODUCTS KABUSHIKI KAISHA, Kakegawa (JP)

(72) Inventors: Yoshiaki Sugita, Shizuoka (JP); Kengo Nishi, Shizuoka (JP)

(73) Assignee: YAMAHA MOTOR POWER PRODUCTS KABUSHIKI KAISHA, Shizuoka (JP)

( * ) Notice: Subject to any disclaimer, the term of this patent is extended or adjusted under 35 U.S.C. 154(b) by 23 days.

(21) Appl. No.: 17/214,982

(22) Filed: Mar. 29, 2021

(65) Prior Publication Data

US 2021/0332748 A1 Oct. 28, 2021

(30) Foreign Application Priority Data

Apr. 28, 2020 (JP) ..... JP2020-078887

(51) Int. Cl.
*F02B 75/22* (2006.01)
*F01L 1/02* (2006.01)
(Continued)

(52) U.S. Cl.
CPC ..... *F02B 75/22* (2013.01); *F01L 1/026* (2013.01); *F02B 29/04* (2013.01); *F02B 39/04* (2013.01); *F02B 2075/1808* (2013.01)

(58) Field of Classification Search
CPC ..... F02B 75/22; F02B 29/04; F02B 39/04; F02B 2075/1808; F01L 1/026
See application file for complete search history.

(56) References Cited

U.S. PATENT DOCUMENTS 2,392,464 A * 1/1946 Daub ..... F02B 25/12 123/51 A
5,911,211 A 6/1999 Uchida
(Continued)

FOREIGN PATENT DOCUMENTS

JP 05-001566 A 1/1993
JP 05-321664 A 12/1993
(Continued)

OTHER PUBLICATIONS

Webpage http://subarupower.com/products/engines/v-twin-series-features-benefits/, Jun. 7, 2019, retrieved from Internet Archive Wayback Machine https://web.archive.org/web/20190607140056/http://subarupower.com/products/engines/v-twin-series-features-benefits/ on Jun. 14, 2022 (Year: 2019).*

*Primary Examiner* — Ngoc T Nguyen
(74) *Attorney, Agent, or Firm* — Keating and Bennett, LLP

(57) ABSTRACT

An OHV engine includes V-shaped banks, a crank shaft, a cam shaft connected to the crank shaft, a mechanical supercharger located between the V-shaped banks, and a power transmission supported by the cam shaft and that connects the crank shaft to the mechanical supercharger. The power transmission includes a gear mechanism with a gear ratio not greater than a predetermined value, and includes a first gear supported rotatably by the cam shaft and that rotates based on an output from the crank shaft, a second gear provided on a rotation shaft of the mechanical supercharger, and an idle gear that connects the first and second gears with each other. Cylinders are offset with respect to a center of the crank shaft on an anti-thrust side of the cylinders, and the mechanical supercharger is also offset with respect to a center of the crank shaft on the anti-thrust side. Cylinder heads are
(Continued)

provided with oil cooling paths adjacent respective spark plugs.

5 Claims, 8 Drawing Sheets

(51) Int. Cl.

| | |
|---|---|
| ***F02B 75/18*** | (2006.01) |
| ***F02B 39/04*** | (2006.01) |
| *F02B 29/04* | (2006.01) |

(56) References Cited

U.S. PATENT DOCUMENTS

| | | | | |
|---|---|---|---|---|
| 2002/0011222 | A1* | 1/2002 | Bilek | F02M 35/116 123/52.1 |
| 2015/0114364 | A1* | 4/2015 | Matsuda | F04D 25/022 123/559.1 |
| 2018/0118317 | A1 | 5/2018 | Ochiai et al. | |
| 2018/0216585 | A1* | 8/2018 | Yoshizumi | F02M 35/10052 |
| 2019/0242275 | A1* | 8/2019 | Chapman, Jr. | F01L 1/026 |

FOREIGN PATENT DOCUMENTS

| | | | |
|---|---|---|---|
| JP | 09-184426 | A | 7/1997 |
| JP | 2012-145040 | A | 8/2012 |
| JP | 2016-121653 | A | 7/2016 |
| JP | 2016-121655 | A | 7/2016 |
| JP | 2018-071446 | A | 5/2018 |

* cited by examiner

V-TYPE OHV ENGINE

CROSS REFERENCE TO RELATED APPLICATIONS

This application claims the benefit of priority to Japanese Patent Application No. 2020-078887 filed on Apr. 28, 2020. The entire contents of this application are hereby incorporated herein by reference.

BACKGROUND OF THE INVENTION

1. Field of the Invention

The present invention relates to V-type OHV engines, and more specifically, to a V-type two-cylinder OHV engine for use in a mower or other equipment.

2. Description of the Related Art

As an example of conventional techniques of this kind, JP-A H5-1566 discloses a V-type engine equipped with a supercharger. The engine includes a pair of banks opposing each other in a left and right direction. The supercharger is provided by a mechanical supercharger disposed between the two banks and driven by an engine output shaft. The V-type engine has an intercooler installed between the two banks, the intercooler and the engine's main body provide a closed space between the two banks, and in this closed space there is provided a cover surrounding the mechanical supercharger. Also, the mechanical supercharger has a drive shaft to which a coupling is connected. A pulley is attached to the coupling's shaft portion. The pulley receives drive power transmitted via a belt from a crank pulley which is attached to a crank shaft so that the mechanical supercharger is rotationally driven.

The V-type engine disclosed in JP-A H5-1566 requires an intercooler installed between the two banks, and therefore it is impossible to miniaturize the V-type engine.

SUMMARY OF THE INVENTION

Preferred embodiments of the present invention provide V-type OHV engines that are each able to be miniaturized.

According to a preferred embodiment of the present invention, an OHV engine includes V-shaped banks, a crank shaft, a cam shaft connected with the crank shaft, a mechanical supercharger located between the V-shaped banks to be driven based on an output from the crank shaft, and a power transmission supported by the cam shaft and that connects the crank shaft and the mechanical supercharger with each other in order to transmit an output from the crank shaft to the mechanical supercharger.

According to a preferred embodiment of the present invention, since the engine is an OHV engine, the cam shaft which is located adjacent to the crank shaft rotatably supports the power transmission that connects the crank shaft and the mechanical supercharger with each other. In other words, the power transmission connects the crank shaft and the mechanical supercharger via the cam shaft. As described above, the cam shaft defines and functions not only conventionally as a member included in a valve driving mechanism but also as a member which supports the power transmission. Therefore, it is possible to decrease the number of parts and to miniaturize the OHV engine that includes the mechanical supercharger.

Preferably, the power transmission includes a gear mechanism. For a task of changing a given number of rotations of the crank shaft into a desired number of rotations and transmitting the output to the mechanical supercharger, a gear mechanism is more advantageous than a belt mechanism as the power transmission in that it is possible to decrease the space. In other words, if the space is the same, a gear mechanism is able to change the number of rotations of the crank shaft into a greater number of rotations than a belt mechanism and transmit the output to the mechanical supercharger. Therefore, by utilizing a gear mechanism as the power transmission, it becomes possible to perform supercharging more efficiently and to miniaturize the engine. The above structural arrangement is effective, in particular, when the number of rotations of the engine is relatively low (about 3,600 rpm, for example).

Further preferably, the gear mechanism has a gear ratio not greater than a predetermined value. When the gear ratio does not exceed a predetermined value, the number of rotations of the mechanical supercharger is controlled. This reduces an increase of the supercharging pressure from the mechanical supercharger, thus reducing a temperature increase of air which enters the engine and preventing undesired detonation in the cylinders. As a result, it becomes possible to further decrease the size of the engine without using an intercooler.

Further, preferably, the gear mechanism includes a first gear supported rotatably by the cam shaft and that is rotated based on an output from the crank shaft, a second gear on a rotation shaft of the mechanical supercharger, and an idle gear connecting the first gear and the second gear with each other. In this case, by placing the idle gear between the first gear and the second gear, it becomes possible to span a distance between the rotation shaft of the first gear and the rotation shaft of the second gear, thus making it possible to flexibly handle the distance between the crank shaft and the mechanical supercharger. Also, it is possible to easily change the number of rotations of the crank shaft to a greater number of rotations with the first gear, the second gear, and the idle gear.

Preferably, the V-shaped banks include two cylinders each offset with respect to a center of the crank shaft toward an anti-thrust side of the two cylinders, that is, in a direction of rotation of the crank shaft, and the mechanical supercharger is offset with respect to the center of the crank shaft in the same direction, i.e., on the anti-thrust side of the two cylinders. By offsetting each of the cylinders of the V-shaped banks on the anti-thrust side as described above, it becomes possible to decrease friction between the pistons and the respective cylinders of the engine, thus increasing torque. Further, by offsetting the mechanical supercharger in the same direction on the anti-thrust side of the two cylinders, it becomes possible to shorten the distance between the crank shaft and the mechanical supercharger, thus decreasing the size of the engine.

Further preferably, each of the V-shaped banks further includes a cylinder head, a spark plug in the cylinder head, and an oil cooling path adjacent to the spark plug in the cylinder head. In this case, engine oil flows in the oil cooling path making it possible to cool a region adjacent the spark plug of the cylinder head. This makes it possible to provide efficient cooling even when the temperature of the engine increases due to supercharging.

Preferred embodiments of the present invention are applicable to V-type two-cylinder OHV engines that are required to be small but yet have a high output.

According preferred embodiments of the present invention, V-type OHV engines are miniaturized.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 4A and 4B show a spark plug and its surroundings in a cylinder head, wherein FIG. 4A is a bottom view and FIG. 4B is a side view.

DETAILED DESCRIPTION OF THE PREFERRED EMBODIMENTS

Hereinafter, preferred embodiments of the present invention will be described with reference to the drawings.

Figure 1:
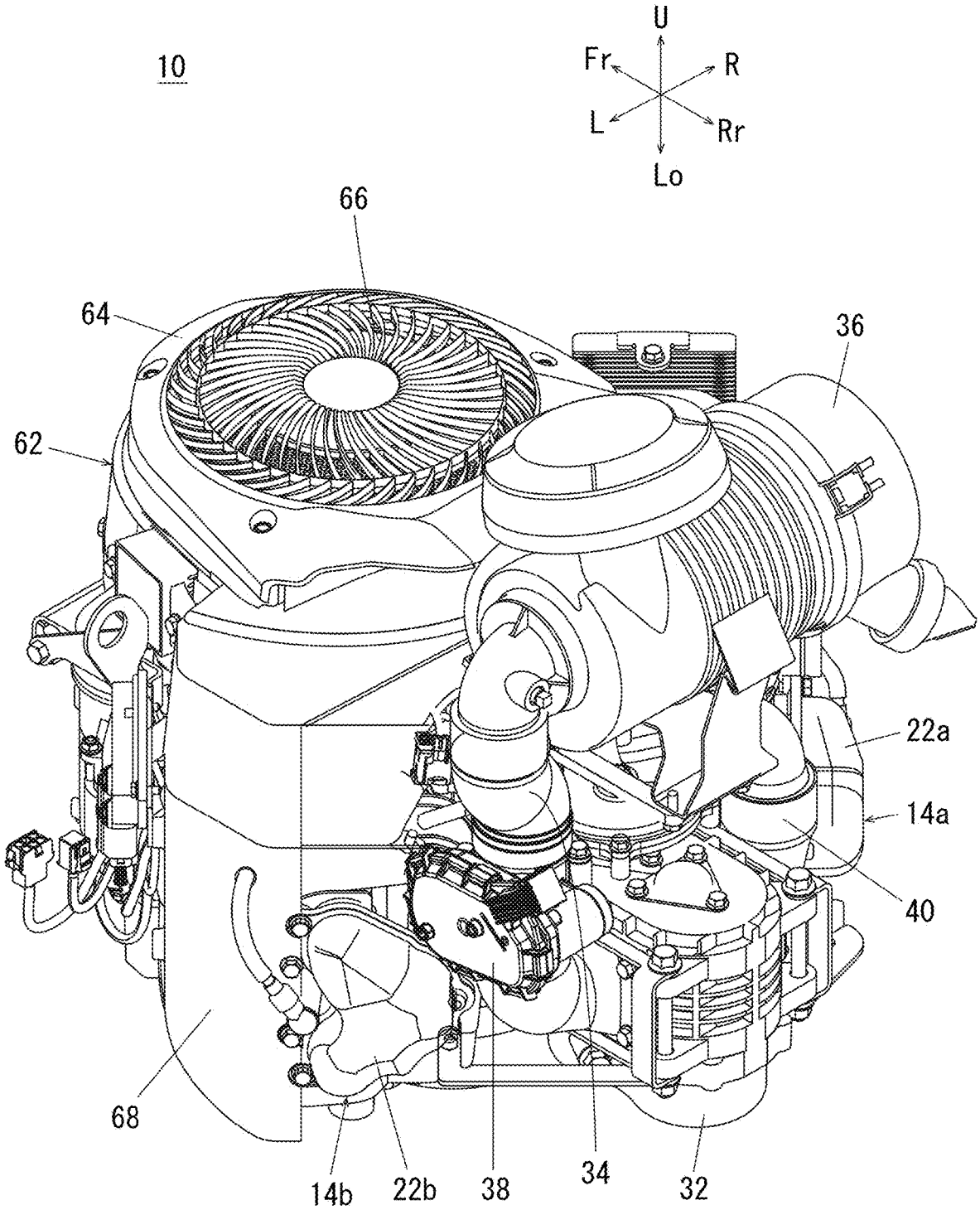
FIG. 1 is a perspective view (taken from diagonally rearward and above) which shows a V-type OHV engine according to a preferred embodiment of the present invention.
Figure 2:
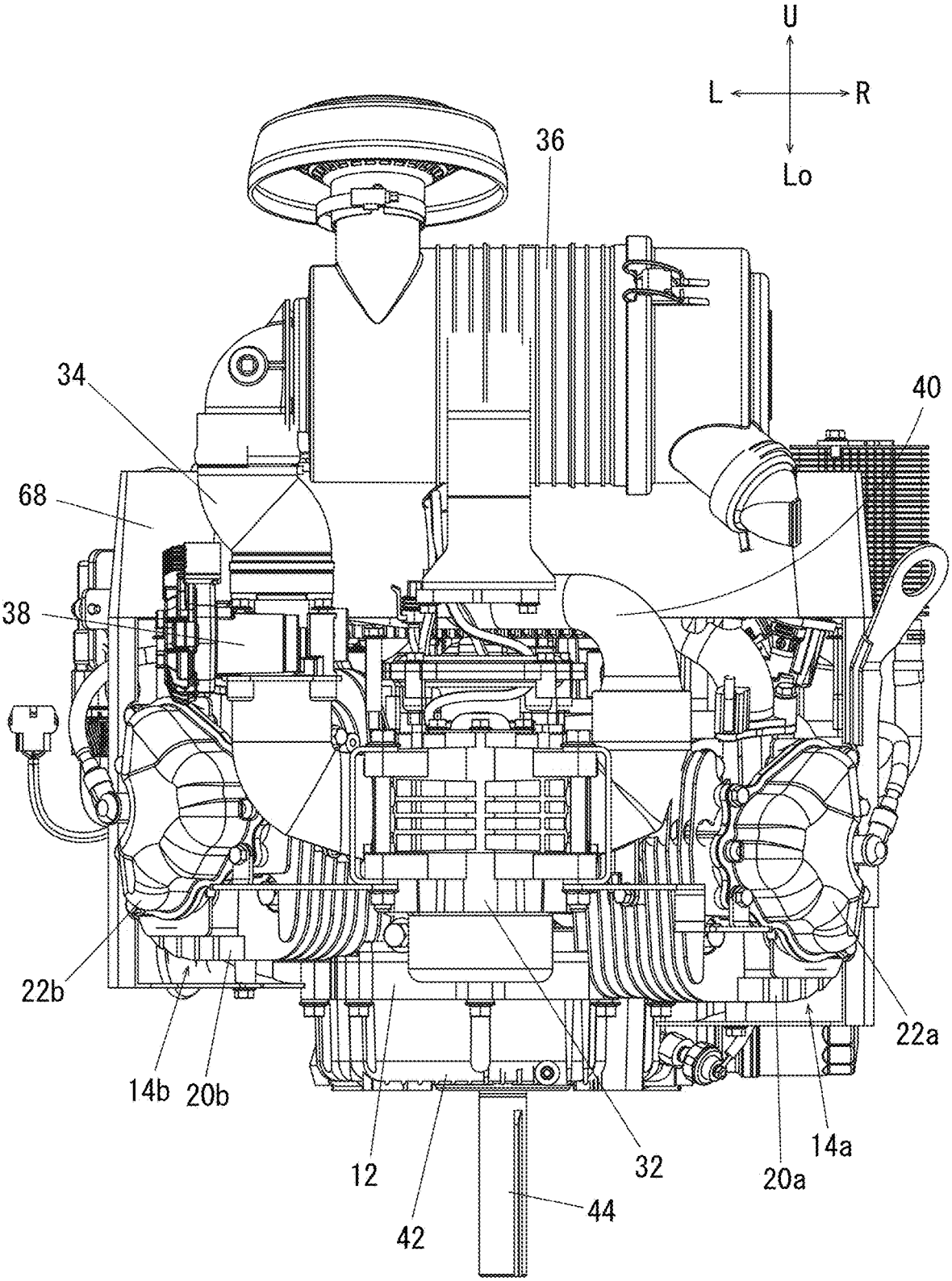
FIG. 2 is a rear view which shows the V-type OHV engine.
Figure 3:
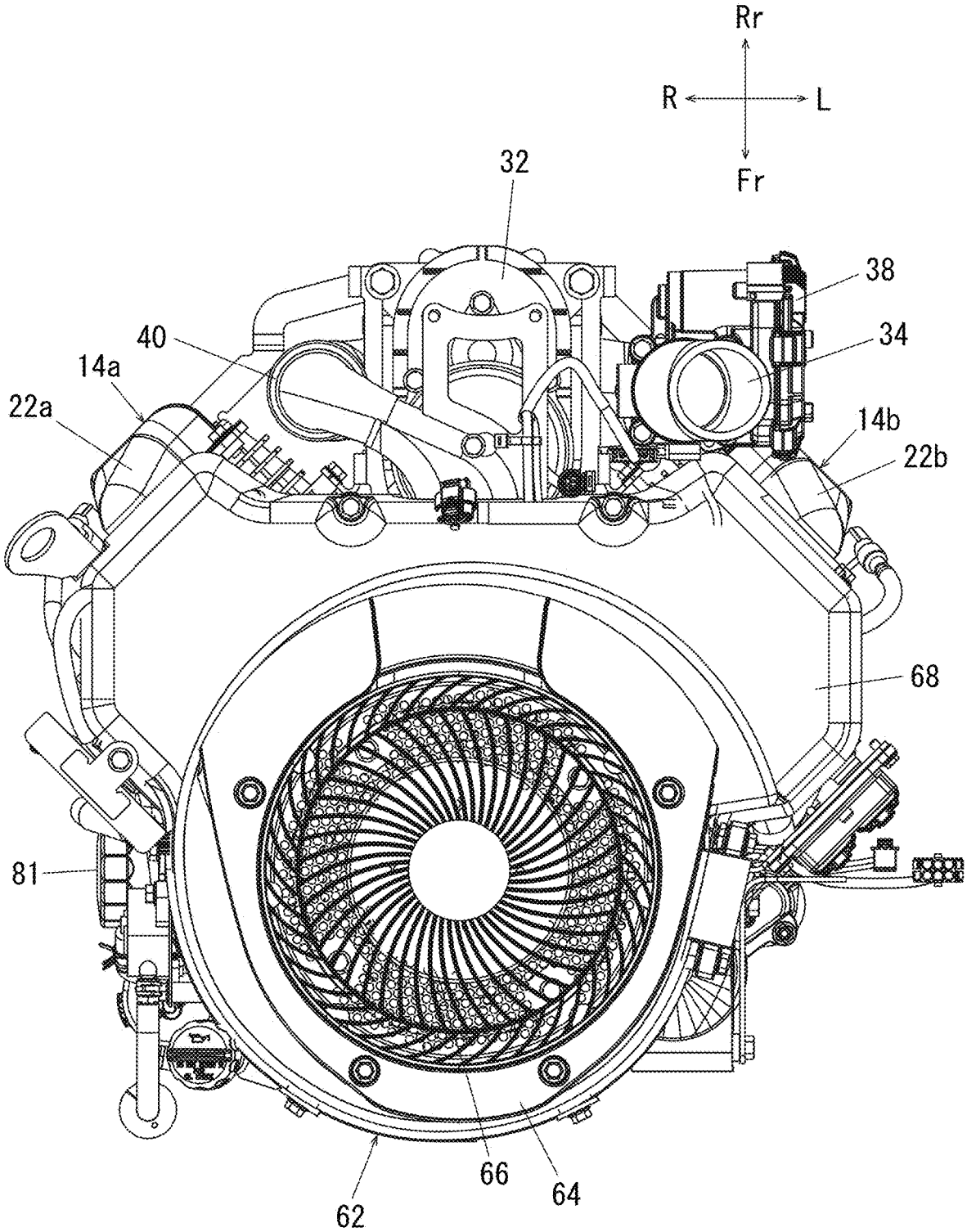
FIG. 3 is a plan view which shows the V-type OHV engine with an air filter removed.

Referring to FIG. 1 through FIG. 3, a V-type OHV engine (hereinafter called the "engine") 10 according to a preferred embodiment of the present invention is a V-type two-cylinder OHV (Over Head Valve) engine, which is used in operation in a vertical orientation. It should be noted that the terms front and rear, left and right, and up and down used in the description of preferred embodiments of the present invention refer to front and rear, left and right, and up and down based on the state in which the engine 10 is oriented vertically, i.e., the state in which a crankshaft 44 (to be described below) extends in the vertical direction. In the drawings, "Fr" indicates forward, "Rr" indicates rearward, "R" indicates rightward, "L" indicates leftward, "U" indicates upward, and "Lo" indicates downward.

The engine 10 includes a crank case 12 and V-shaped banks 16. The crank case 12 is provided, on its side surfaces, with two cylinders 14*a*, 14*b* in a shape of a V. By orienting the cylinders 14*a*, 14*b* in the shape of V when viewed in a plan view, the V-shaped banks 16 protrude from side surfaces of the crank case 12 (see FIG. 7).

Figure 6:
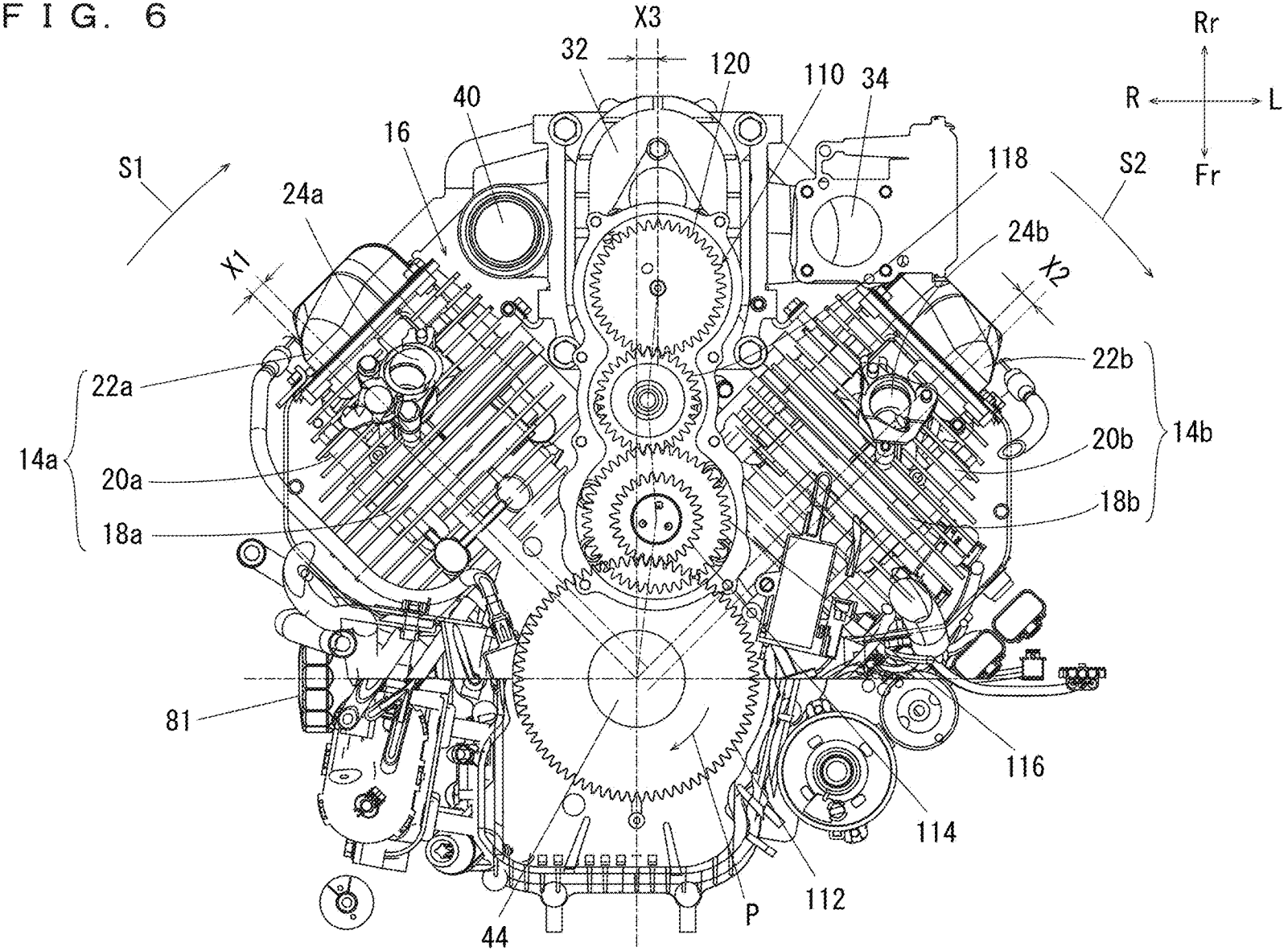
FIG. 6 is an illustrative sectional view of the V-type OHV engine taken along line A-A in FIG. 5.
Figure 7:
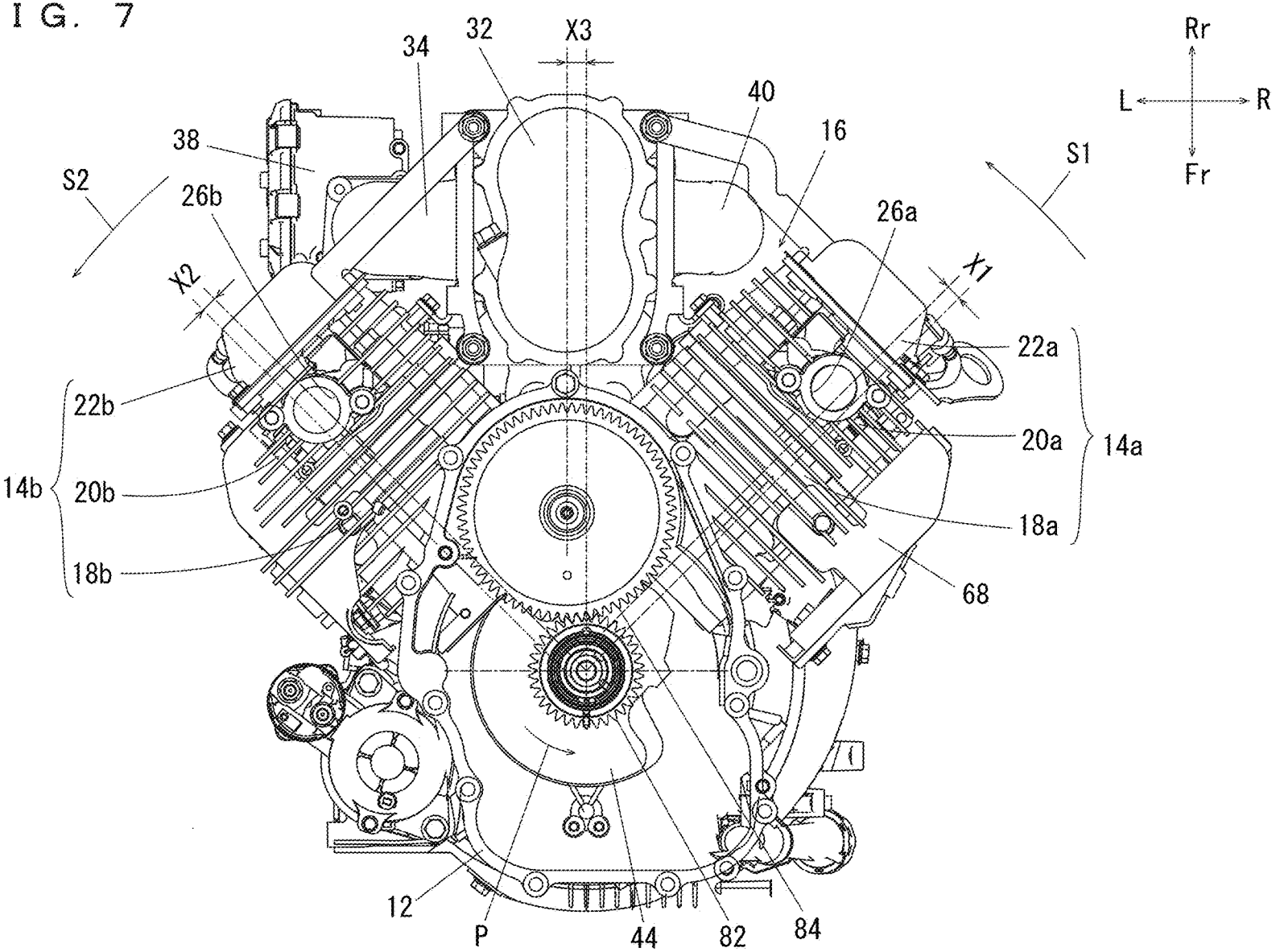
FIG. 7 is an illustrative sectional view of the V-type OHV engine taken along line B-B in FIG. 5.

Referring to FIG. 6 and FIG. 7, the cylinders 14*a*, 14*b* are offset on an anti-thrust side in a direction of rotation of the crank shaft 44, i.e., offset from the center of the crank shaft 44 in the direction of rotation of the crank shaft 44. In other words, the V-shaped banks 16 include the cylinders 14*a*, 14*b* which are offset toward the anti-thrust side. In the present preferred embodiment, the crank shaft 44 is rotated in a direction indicated by Arrow P, and the cylinders 14*a*, 14*b* are offset toward the anti-thrust side indicated by Arrows S1 and S2 respectively, i.e., offset in the same direction as the direction of rotation of the crank shaft 44. In other words, each of the cylinders 14*a*, 14*b* is offset with respect to a center of the crank shaft 44 on one side of the engine 10 (more specifically, on the left side indicated by "L"). The amount of the offset of the cylinders 14*a*, 14*b* is indicated by X1 and X2 respectively. The cylinders 14*a*, 14*b* respectively include cylinder blocks 18*a*, 18*b*, cylinder heads 20*a*, 20*b*, and cylinder head covers 22*a*, 22*b*. Referring to FIG. 7, the cylinder blocks 18*a*, 18*b* include the crank case 12 integrally therewith. Each of the cylinder blocks 18*a*, 18*b* is provided therein with a piston (not illustrated) in a slidable manner. A connecting rod (not illustrated) connects the piston to the crank shaft 44 inside the crank case 12. The crank shaft 44 converts reciprocating motion of the piston into rotating motion.

Figure 4A:
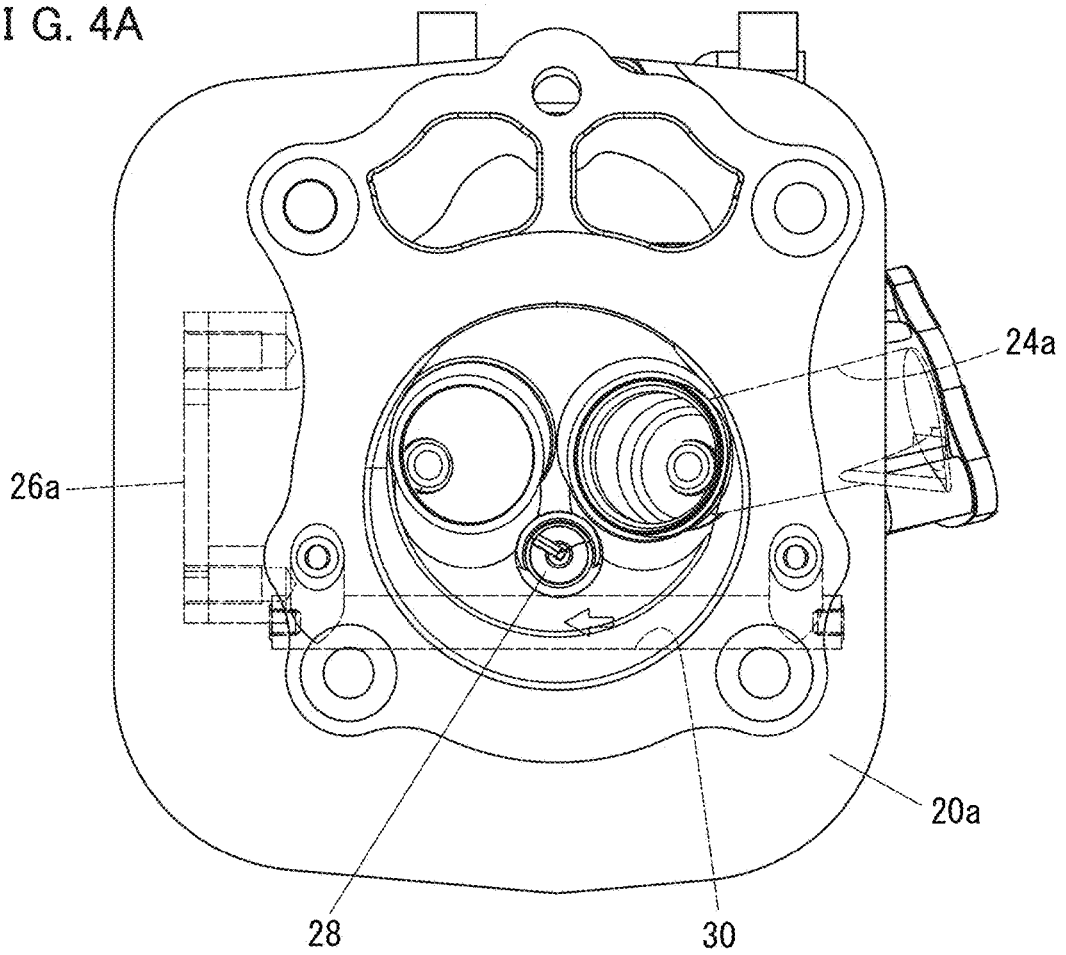
Figure 4B:
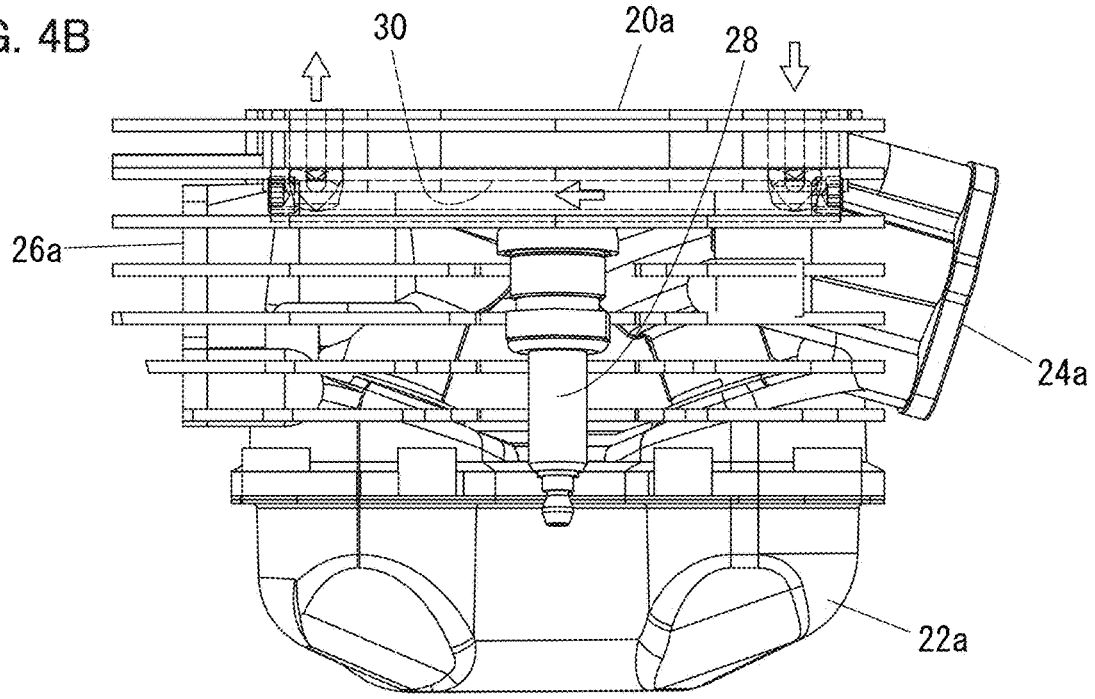

Referring to FIG. 6 and FIG. 7, the cylinder heads 20*a*, 20*b* are provided respectively with intake ports 24*a*, 24*b* on their upper surface side, and exhaust ports 26*a*, 26*b* on their lower surface side. Referring to FIGS. 4A and 4B, the cylinder head 20*a* is provided with a spark plug 28, and an oil cooling path 30 is provided adjacent the spark plug 28 in the cylinder head 20*a*. Likewise, the cylinder head 20*b* is provided with a spark plug 28 and an oil cooling path 30.

A mechanical supercharger 32 is located between the V-shaped banks 16, i.e., between the cylinders 14*a*, 14*b*. The mechanical supercharger 32 is offset with respect to a center of the crank shaft 44 in the same direction as the anti-thrust side of the cylinders 14*a*, 14*b*. In the present preferred embodiment, the mechanical supercharger 32 is, for example, a roots-blower supercharger. The mechanical supercharger 32 is offset with respect to the center of the crank shaft 44 toward one side (more specifically to the left side indicated by "L") of the engine 10, with an amount of offset of the mechanical supercharger 32 indicated by X3.

Returning to FIG. 1 through FIG. 3, an air filter 36 is connected to an inlet of the mechanical supercharger 32 via an intake tube 34. The intake tube 34 is provided with a throttle body 38. Therefore, air which enters the air filter 36 flows through the intake tube 34 and then into the mechanical supercharger 32 according to an opening degree of a throttle valve (not illustrated) inside the throttle body 38. The mechanical supercharger 32 is driven based on an output from the crank shaft 44. The mechanical supercharger 32 has its outlet connected with the intake ports 24*a*, 24*b* of the cylinders 14*a*, 14*b* via an intake manifold 40. Therefore, the mechanical supercharger 32 supplies air to the cylinders 14*a*, 14*b* at a supercharging pressure according to the output from the crank shaft 44. It should be noted that the exhaust ports 26*a*, 26*b* of the cylinders 14*a*, 14*b* are connected with a muffler (not illustrated) via respective exhaust pipes (not illustrated), so that exhaust gas from the engine 10 is discharged to the outside via the muffler.

Figure 5:
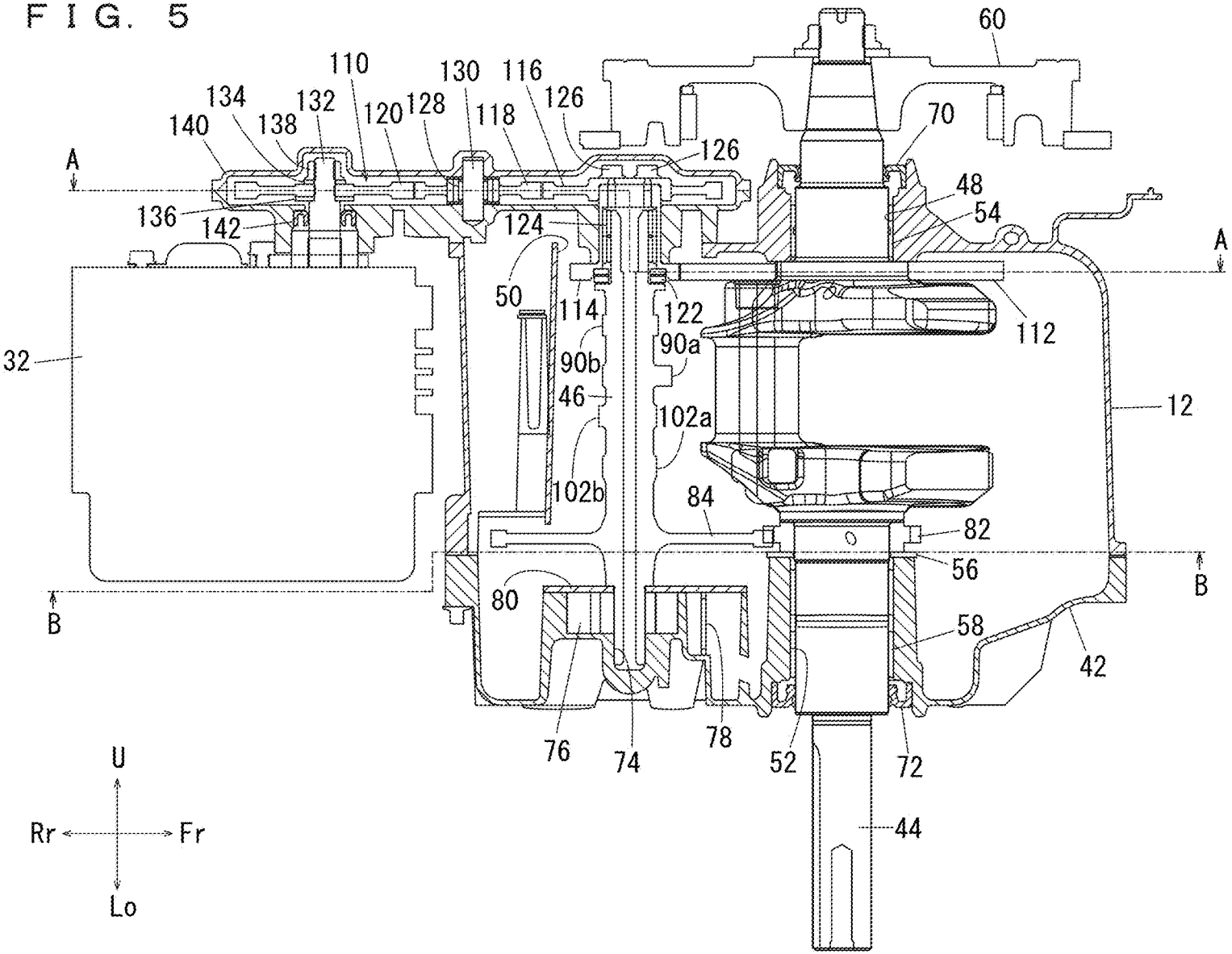
FIG. 5 is an illustrative longitudinal sectional view which shows a crank shaft, a cam shaft, a mechanical supercharger, etc.

Referring to FIG. 2 and FIG. 5, an oil pan 42 is provided below the crank case 12. Inside the crank case 12 and the oil pan 42, the crank shaft 44 and a cam shaft 46 are provided so that their axial direction is in the up-down direction. The crank shaft 44 penetrates the crank case 12 and the oil pan 42 in the up-down direction. The cam shaft 46 is connected with the crank shaft 44, and penetrates an upper surface of the crank case 12.

Referring to FIG. 5, the crank case 12 includes a through-hole 48 penetrated by the crank shaft 44, and a through-hole 50 penetrated by the cam shaft 46. The oil pan 42 includes a through-hole 52 penetrated by the crank shaft 44. The crank shaft 44 has its upper portion supported by the crank case 12 via a bearing 54 provided in the through-hole 48, while the crank shaft 44 has its lower portion supported by the oil pan 42 via a washer 56 and a bearing 58 provided in the through-hole 52. As described above, the crank shaft 44 is provided in such a way to penetrate the crank case 12 and the oil pan 42 in the up-down direction, the oil pan 42 rotatably supports one portion of the crank shaft 44, and the crank case 12 rotatably supports another portion of the crank shaft 44.

Above the crank case 12, a cooling fan 60 is provided coaxially with the crank shaft 44 (FIG. 5 shows a fan supporting portion only). Above the crank case 12, a fan case 62 is provided to cover the cooling fan 60 (see FIG. 1 and FIG. 3). The fan case 62 includes a cover 64, and the cover 64 includes an air inlet 66 facing the cooling fan 60 to introduce air. The cooling fan 60 is driven by the crank shaft 44. As the cooling fan 60 is driven, outside air is introduced from the air inlet 66 and cools the engine 10. Also, a shroud 68 is provided to cover at least a portion of side and front surfaces of the cylinders 14*a*, 14*b*.

Returning to FIG. 5, in the through-hole 48, an oil seal 70 is provided between the crank case 12 and the crank shaft 44. In the through-hole 52, an oil seal 72 is provided between the oil pan 42 and the crank shaft 44.

The cam shaft 46 includes a first end inserted into a recess 74 in the oil pan 42, and that is supported rotatably by the oil pan 42 via a film of oil. The cam shaft 46 includes a second end connected rotatably with a power transmission 110 (which will be described below).

Inside the oil pan 42, below the cam shaft 46, an oil pump 76 is installed coaxially with the cam shaft 46, and an oil strainer 78 is provided adjacent the oil pump 76. On the oil pump 76, a cover 80 is provided. The oil pump 76 is driven as the cam shaft 46 rotates. The oil pan 42 stores engine oil. The engine oil passes through the oil strainer 78 and is supplied to the oil pump 76. The oil pump 76 pumps the oil, through an oil filter 81 (see FIG. 3 and FIG. 6), to various regions of the engine 10. As indicated by a white arrow in FIGS. 4A and 4B, for example, the oil is sent also to the oil cooling paths 30 in the cylinder heads 20*a*, 20*b*.

The crank shaft 44 is provided with a drive gear 82, and the cam shaft 46 is provided with a driven gear 84 which rotates as the drive gear 82 rotates. Thus, the cam shaft 46 is rotatable in association with the crank shaft 44.

The cylinders 14*a*, 14*b* are respectively provided with communication paths (not illustrated), which extend from the cylinder blocks 18*a*, 18*b* to the cylinder heads 20*a*, 20*b*, to provide communication between the inside of the crank case 12 and rocker arm rooms (not illustrated) inside the cylinder head covers 22*a*, 22*b*.

Figure 8:
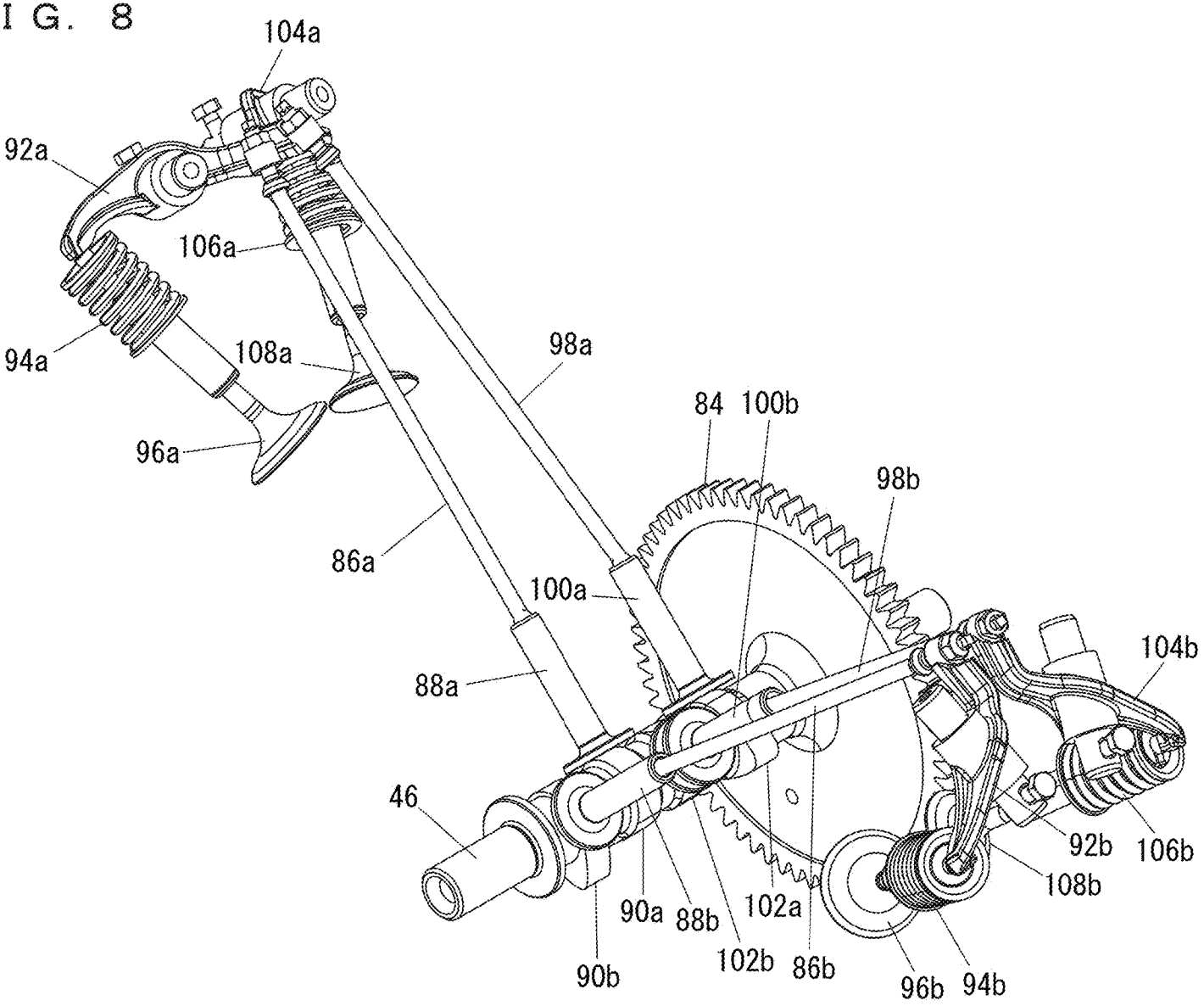
FIG. 8 is a perspective view which shows a valve driving mechanism.

Referring to FIG. 8, in the cylinder 14*a*, a push rod 86*a* and a tappet 88*a* provided at a first end of the push rod 86*a* are inserted into the communication path. The tappet 88*a* has its tip end contacted by an intake cam 90*a* of the cam shaft 46 inside the crank case 12. The push rod 86*a* has its second end connected to a rocker arm 92*a* provided inside the rocker arm room. The rocker arm 92*a* drives an intake valve 96*a* which is constantly urged by a valve spring 94*a* to close. The intake valve 96*a* opens and closes the intake port 24*a*. Also, a push rod 98*a* and a tappet 100*a* which is provided at a first end of the push rod 98*a* are inserted into the communication path. The tappet 100*a* has its tip end contacted by an exhaust cam 102*a* of the cam shaft 46 inside the crank case 12. The push rod 98*a* has its second end connected to a rocker arm 104*a* provided inside the rocker arm room. The rocker arm 104*a* drives an exhaust valve 108*a* which is constantly urged by a valve spring 106*a* to close. The exhaust valve 108*a* opens and closes the exhaust port 26*a*. The cylinder 14*b* includes the same valve driving mechanism as the valve driving mechanism for the cylinder 14*a* described above, and therefore, the description will not be repeated herein since it should be clear from the description given above when a letter "a" is replaced with the letter "b".

Returning to FIG. 5, the power transmission 110 is supported by the cam shaft 46 and connects the crank shaft 44 and the mechanical supercharger 32 with each other in order to transmit an output from the crank shaft 44 to the mechanical supercharger 32. The power transmission 110 includes a gear mechanism, which includes gears 112, 114, 116, 118, and 120. The gear 112 is provided on the crank shaft 44. The gear 114 is hat-shaped and is fitted to an outer circumference of the cam shaft 46 so as to provide double axes on the cam shaft 46. The gear 114 meshes with the gear 112, and is rotated based on an output from the crank shaft 44. Bearings 122, 124 are inserted between the gear 114 and the cam shaft 46, and the gear 114 is rotatably supported by the cam shaft 46. Also, the gear 114 is rotatably supported by a gear cover 140 (which will be described below) via a film of oil. At a tip end of the gear 114, the gear 116 is coaxially attached with two fasteners 126. Therefore, the gear 116 is rotated based on an output from the crank shaft 44, and supported rotatably by the cam shaft 46 via the gear 114. The gear 116 meshes with the gear 118. Further, the gear 118 meshes with the gear 120. In other words, the gear 116 and the gear 120 are connected with each other by the gear 118. The gear 118 includes a pin 130 and is rotatably supported by a gear cover 140 via a bearing 128, wherein the pin 130 functions as a shaft for the gear cover 140. The pin 130 is held by the gear cover 140. The gear 120 is fixed to a rotation shaft 132 of the mechanical supercharger 32. In other words, the gear 120 is provided with washers 134, 136 above and below, and in this state the rotation shaft 132 is inserted through the gear 120 and the washers 134, 136, and then a nut 138 is threaded on an end of the rotation shaft 132. This structural arrangement causes the gear 120 and the rotation shaft 132 to rotate integrally with each other. The gears 116, 118, and 120 of the power transmission 110 are covered by the gear cover 140. The gear cover 140 is supported by the crank case 12 and the mechanical supercharger 32. An oil seal 142 is provided between the gear cover 140 and the rotation shaft 132. The power transmission 110 including the gear mechanism described above, i.e., the gears 112, 114, 116, 118, and 120, has a gear ratio (speed increase ratio) not greater than a predetermined value, preferably not greater than about 3.1, for example. For example, if the gear ratio is 3.1, the number of rotations of the rotation shaft 132 of the mechanical supercharger 32 is 11,160 rpm when the number of rotations of the crank shaft 44 is 3,600 rpm.

In the present preferred embodiment, the gear 116 represents a first gear, the gear 118 represents an idle gear, and the gear 120 represents a second gear.

According to the engine 10, since it is an OHV engine, the cam shaft 46 is located adjacent to the crank shaft 44 and rotatably supports the power transmission 110 which connects the crank shaft 44 and the mechanical supercharger 32 with each other. In other words, the power transmission 110 connects between the crank shaft 44 and the mechanical supercharger 32 via the cam shaft 46. As described, the cam shaft 46 functions not only conventionally as a member included in a valve driving mechanism but also as a member which supports the power transmission 110. Therefore, it is possible to decrease the number of parts and to miniaturize the engine 10 which includes the mechanical supercharger 32.

For a task of changing a given number of rotations of the crank shaft 44 into a desired number of rotations and transmitting the output to the mechanical supercharger 32, a gear mechanism is more advantageous than a belt mechanism as the power transmission 110 in that it is possible to decrease space. In other words, if the space is the same, a gear mechanism is able to change the number of rotations of the crank shaft 44 into a greater number of rotations than a belt mechanism and transmit the output to the mechanical supercharger 32. Therefore, by utilizing a gear mechanism as the power transmission 110, it becomes possible to perform supercharging more efficiently and to miniaturize the engine 10. This structural arrangement is effective, in particular, when the number of rotations of the engine is relatively low (about 3,600 rpm, for example).

The number of rotations of the mechanical supercharger 32 is controlled by a gear ratio of the power transmission 110 that does not exceed a predetermined value. This structural arrangement reduces an increase in the supercharging pressure from the mechanical supercharger 32, thus reducing a temperature increase of air which enters the engine 10 and preventing undesired detonation in the cylinders. As a result, it becomes possible to further decrease the size of the engine 10 without using an intercooler.

By placing the idle gear, which is provided by the gear 118, between the gear 116 and the gear 120, it becomes possible to span a distance between the rotation shaft of the gear 116 (the gear 114 and the cam shaft 46) and the rotation shaft of the gear 120 (the rotation shaft 132 of the mechanical supercharger 32), making it possible to flexibly handle the distance between the crank shaft 44 and the mechanical supercharger 32. Also, it is possible to easily change the number of rotations of the crank shaft 44 to a greater number of rotations with the gear 116, the gear 120, and the gear 118. In the present preferred embodiment, one idle gear is sufficient.

By offsetting each of the cylinders 14*a*, 14*b* of the V the banks 16 on the anti-thrust side, i.e., in the direction of rotation of the crank shaft 44, it becomes possible to decrease friction between the pistons and the respective cylinders 14*a*, 14*b* of the engine 10, thus increasing torque. Further, by also offsetting the mechanical supercharger 32 in the same direction, i.e., on the anti-thrust side of which the cylinders 14*a*, 14*b* are offset, it becomes possible to shorten the distance between the crank shaft 44 and the mechanical supercharger 32, thus decreasing the size of the engine 10.

The engine oil that flows in the oil cooling paths 30 makes it possible to cool regions adjacent the spark plugs 28 of the cylinder heads 20*a*, 20*b*. This makes it possible to provide efficient cooling even when temperature of the engine 10 increases due to supercharging. Also, if the cylinder heads 20*a*, 20*b* are made from die casting, it is possible to easily form the oil cooling path 30 by a drilling process.

Preferred embodiments of the present invention are applicable to V-type two-cylinder OHV engines that are required to be small but yet have a high output.

The engine 10 is suitably used in mowing equipment, for example. However, the application of the engine 10 is not limited to mowing equipment, and the engine 10 may be utilized as a general-purpose engine.

In the preferred embodiments of the present invention described above, description was made for a case in which the engine 10 is a V-type two-cylinder OHV engine. However, preferred embodiments of the present invention are not limited to this. Preferred embodiments of the present invention are applicable to any V-type OHV engine.

In the preferred embodiments of the present invention described above, description was made for a case in which the engine 10 is oriented vertically during use. However, preferred embodiments of the present invention are not limited to this. The engine 10 may also be used suitably when oriented horizontally.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An OHV engine comprising:

V-shaped banks;

a crank shaft;

a cam shaft connected to the crank shaft;

a mechanical supercharger located between the V-shaped banks to be driven based on an output from the crank shaft; and a power transmission supported by the cam shaft and connecting the crank shaft and the mechanical supercharger with each other in order to transmit an output from the crank shaft to the mechanical supercharger; wherein the power transmission includes a gear mechanism; and the gear mechanism includes a first gear supported rotatably by the cam shaft to rotate based on an output from the crank shaft, a second gear provided on a rotation shaft of the mechanical supercharger, and an idle gear that connects the first gear and the second gear with each other.

2. The OHV engine according to claim 1, wherein the gear mechanism has a gear ratio not greater than a predetermined value.

3. An OHV engine comprising:

V-shaped banks;

a crank shaft;

a cam shaft connected to the crank shaft;

a mechanical supercharger located between the V-shaped banks to be driven based on an output from the crank shaft; and a power transmission supported by the cam shaft and connecting the crank shaft and the mechanical supercharger with each other in order to transmit an output from the crank shaft to the mechanical supercharger; wherein the V-shaped banks include two cylinders each offset with respect to a center of the crank shaft on an anti-thrust side of the two cylinders in a direction of rotation of the crank shaft; and the mechanical supercharger is offset with respect to the center of the crank shaft on the anti-thrust side of the two cylinders.

4. The OHV engine according to claim 1, wherein each of the V-shaped banks includes a cylinder head, a spark plug in the cylinder head, and an oil cooling path in the cylinder head adjacent to the spark plug.

5. The OHV engine according to claim 1, wherein the V-shaped banks include two cylinders.

* * * * *